US005945266A

United States Patent [19]

Maskasky et al.

[11] Patent Number: 5,945,266

[45] Date of Patent: Aug. 31, 1999

[54] DYE IMAGE FORMING PHOTOGRAPHIC ELEMENT AND PROCESSING TO PRODUCE A VIEWABLE IMAGE

[75] Inventors: Joe E. Maskasky; Victor P. Scaccia, both of Rochester, N.Y.

[73] Assignee: Eastman Kodak Company, Rochester, N.Y.

[21] Appl. No.: 09/118,172

[22] Filed: Jul. 17, 1998

[51] Int. Cl.[6] ..... G03C 1/77

[52] U.S. Cl. ..... 430/524; 430/357; 430/531

[58] Field of Search ..... 430/524, 531

[56] References Cited

U.S. PATENT DOCUMENTS 4,948,719 8/1990 Koike et al. ..... 430/524

OTHER PUBLICATIONS

Research Disclosure, vol. 389, Sep. 1996, Item 39857, IVIII.
Research Disclosure, vol. 389, Sep. 1996, Item 38957, XIX.
Product Licensing Index, Vo. 92, Dec. 1971, Item 9232.

*Primary Examiner*—Hoa Van Le
*Attorney, Agent, or Firm*—Carl O. Thomas

[57] ABSTRACT

Increased speed with minimal halation is provided by a photographic element having a specularly reflective silver mirror coating coated between a hydrophilic colloid containing crosslinking sites forming an undercoat and a silver halide emulsion layer unit containing a hydrophilic colloid having crosslinking sites, radiation-sensitive silver halide grains, and a dye image-forming compound.

Following imagewise exposure, photographic processing is conducted by (1) developing the photographic element with a color developing agent to create a dye image, (2) converting to silver halide the silver mirror coating and the silver produced by development, and (3) fixing the photographic element while concurrently crosslinking the hydrophilic colloid contained in the emulsion layer unit to the hydrophilic colloid contained in the undercoat.

17 Claims, No Drawings

DYE IMAGE FORMING PHOTOGRAPHIC ELEMENT AND PROCESSING TO PRODUCE A VIEWABLE IMAGE

FIELD OF THE INVENTION

The invention relates to silver halide photography. More specifically, the invention relates to color photographic elements and to their photographic processing to produce a viewable dye image.

BACKGROUND

Color negative photographic elements are conventionally formed with superimposed red, green and blue recording layer units coated on a support.

The red, green and blue recording layer units contain radiation-sensitive silver halide emulsions that form a latent image in response to red, green and blue light, respectively. Additionally, the red recording layer unit contains a cyan dye image-forming coupler, the green recording layer unit contains a magenta dye image-forming coupler, and the blue recording layer unit contains a yellow dye image-forming coupler. Following imagewise exposure, the color negative photographic elements are processed in a color developer, which contains a color developing agent that is oxidized while selectively reducing to silver latent image bearing silver halide grains. The oxidized color developing agent then reacts with the dye image-forming coupler in the vicinity of the developed grains to produce a dye image. Cyan (red-absorbing), magenta (green-absorbing) and yellow (blue-absorbing) dye images are formed in the red, green and blue recording layer units, respectively. Subsequently the element is bleached (i.e., developed silver is converted back to silver halide) to eliminate neutral density attributable to developed silver and then fixed (i.e., silver halide is removed) to provide stability during subsequent room light handling.

Systems for processing color negative photographic elements are included among those disclosed in *Research Disclosure*, Item 38957, XVIII. Chemical development systems. Color developing agents are included among developing agents disclosed in Item 38957, XIX. Development, A. Developing Agents.

A type of color negative processing that is widely used is the Kodak Flexicolor™ color negative process. Since minor adjustments of the C-41 process are undertaken from time to time, the following detailed description is provided:

| | | |
|---|---|---|
| Develop | 3'15" Developer | 37.8° C. |
| Bleach | 4' Bleach | 37.8° C. |
| Wash | 3' | 35.5° C. |
| Fix | 4' Fixer | 37.8° C. |
| Wash | 3' | 35.5° C. |
| Rinse | 1' Rinse | 37.8° C. |

Developer

| | |
|---|---|
| Water | 800.0 mL |
| Potassium Carbonate, anhydrous | 34.30 g |
| Potassium bicarbonate | 2.32 g |
| Sodium sulfite, anhydrous | 0.38 g |
| Sodium metabisulfite | 2.96 g |
| Potassium Iodide | 1.20 mg |
| Sodium Bromide | 1.31 g |
| Diethylenetriaminepentaacetic acid pentasodium salt (40% soln) | 8.43 g |
| Hydroxylamine sulfate | 2.41 g |

-continued

| | |
|---|---|
| N-(4-amino-3-methylphenyl)-N-ethyl-2-aminoethanol | 4.52 g |
| Water to make | 1.0 L |
| pH @ 26.7° C. 10.00 +/− 0.05 | |

Bleach

| | |
|---|---|
| Water | 500.0 mL |
| 1,3-Propylenediamine tetraacetic acid | 37.4 g |
| 57% Ammonium hydroxide | 70.0 mL |
| Acetic acid | 80.0 mL |
| 2-Hydroxy-1,3-propylenediamine tetraacetic acid | 0.8 g |
| Ammonium Bromide | 25.0 g |
| Ferric nitrate nonahydrate | 44.85 g |
| Water to make | 1.0 L |
| pH 4.75 | |

Fix

| | |
|---|---|
| Water | 500.0 mL |
| Ammonium Thiosulfate (58% solution) | 214.0 g |
| (Ethylenedinitrilo)tetraacetic acid disodium salt, dihydrate | 1.29 g |
| Sodium metabisulfite | 11.0 g |
| Sodium Hydroxide (50% solution) | 4.70 g |
| Water to make | 1.0 L |
| pH at 26.7° C. 6.5 +/− 0.15 | |

Rinse

| | |
|---|---|
| Water | 900.0 mL |
| 0.5% Aqueous p-tertiary-octyl-(α-phenoxypolyethyl)alcohol | 3.0 mL |
| Water to make | 1.0 L |

When processing is conducted as noted above, negative dye images are produced. To produce a viewable positive dye image and hence to produce a visual approximation of the hues of the subject photographed, white light is typically passed through the color negative image to expose a second color photographic element having red, green and blue recording layer units as described above, usually coated on a white reflective support. The second element is commonly referred to as a color print element, and the process of exposing the color print element through the image bearing color negative element is commonly referred to as printing. Processing of the color print element as described above produces a viewable positive image that approximates that of the subject originally photographed.

A type of color print processing that is widely used is the Kodak™ RA-4 process. Since minor adjustments of the RA-4 process are undertaken from time to time, the following detailed description is provided:

| | | |
|---|---|---|
| Develop | 45" Developer | 35° C. |
| Bleach | 45" Bleach-Fix | 35° C. |
| Stabilize | 90" Stabilizer | 35° C. |

Developer

| | |
|---|---|
| Lithium salt of sulfonated polystyrene(1) | 0.25 mL |
| Triethanolamine | 11.0 mL |
| N,N'diethylhydroxylamine(2) | 6.0 mL |
| Potassium sulfite(3) | 0.5 mL |
| Color developing agent(4) | 5.0 g |
| Stain reducing agent(5) | 2.3 g |
| Potassium chloride | 2.3 g |
| Ethylenediaminetetraacetic acid, disodium salt monohydrate | 3.0 g |
| 3,4-Dihydroxy-1,2,5-benzenetrisulfonic acid, trisodium salt | 0.6 g |
| Potassium carbonate | 25.0 g |

-continued

| | |
|---|---|
| Water to make | 1.0 L |
| pH @ 35° C. 10.04 | |

(1)30% by weight aqueous solution.
(2)85% by weight aqueous solution.
(3)45% by weight aqueous solution.
(4)4-(N-ethyl-N-2-methanesulfonylaminoethyl)-2-methylphenylenediamine sesquisulfate monohydrate.
(5)Kodak Ektaprint 2 ™ stain-reducing agent (a stilbene compound).

Bleach-Fix

This is an aqueous composition of ammonium thiosulfate, sodium bisulfite, and an ammonium salt of the ferric complex of ethylenediaminetetraacetic acid having a pH of 6.2.

Stabilizing Composition

This is an aqueous composition of formaldehyde, sodium metabisulfite, potassium hydroxide, diethylene glycol, 5-chloro-2-methyl4-iso-thiazolin-3-one, the disodium salt of ethylenediaminetetraacetic acid, and 1-hydroxyethylidene-1,1,-diphosphonic acid having a pH of 7.2. The diethylene glycol serves as a solvent for the 5-chloro-2-methyl4-iso-thiazolin-3-one.

Color negative photographic elements are commonly exposed in a camera. Since lighting of the subject sought to be photographed can vary, it is usually desirable to obtain the highest levels of imaging speed consistent with the image structure (granularity and acuity) desired. One of the inefficiencies that limits the speed of color negative elements is that only a portion of the exposing light is absorbed within the recording layer units. The remainder of the light passes through unutilized.

If a color negative element were constructed with only the essential elements described above, the unabsorbed light would pass through the transparent support. At the back surface of the support the refractive index difference between the support and air causes a portion of the light to be back scattered. Any portion of back scattered light that is absorbed within the recording layer units results in halation, which reduces image sharpness. Therefore, it is common practice to provide a light absorbing (antihalation) layer either between the recording layer units and the support or on the back side of the support to absorb the light that is not absorbed by the recording layer units during its initial traverse. To allow printing through the fully processed color negative element, the antihalation layer is constructed to be decolorized during photographic processing.

Color print elements are typically exposed using a controlled light source. Therefore, lower imaging speeds than exhibited by color negative elements are typical. Since photographically processed color print elements are intended for viewing, the primary concern is for sharp images and low stain in minimum density areas. The incorporation of an antihalation layer increases image sharpness, but when incomplete decolorization of the antihalation layer occurs during photographic processing, the result is visually objectionable stain in minimum density areas.

Although color negative elements most commonly employ transparent film supports and color print elements most commonly employ white reflective (typically paper) supports, it is generally recognized that in theory the support of a photographic element can take any convenient form (1) capable of providing dimensional stability for the emulsion layers and (2) not detrimentally chemically interactive with the emulsion layers. Thus, a wide variety of materials, other than film and paper, such as glass, wood, and metal sheets and foils, as illustrated by *Product Licensing Index*, Vol. 92, December 1971, Item 9232, have been used from time to time as photographic supports. *Research Disclosure* and *Product Licensing Index* are published by Kenneth Mason Publications, Ltd., Dudley House, 12 North St., Emsworth, Hampshire P010 7DQ, England.

PROBLEMS TO BE SOLVED

This invention addresses the need for obtaining higher imaging speeds while maintaining acceptable image structure, both in terms of image granularity (noise) and acuity (sharpness).

This invention eliminates the need to rely on antihalation layers to achieve acceptable image acuity. This also eliminates concerns of residual stain attributable to incomplete decolorization of antihalation layers during photographic processing.

SUMMARY OF THE INVENTION

In one aspect this invention is directed to a photographic element comprised of a support and, coated on the support, an undercoat comprised of a hydrophilic colloid containing crosslinking sites, a specularly reflective silver mirror coating, and an emulsion layer unit comprised of a hydrophilic colloid containing crosslinking sites, radiation-sensitive silver halide grains, and a dye image-forming compound.

In another aspect this invention is directed to a process of producing a viewable image comprising (1) developing an imagewise exposed photographic element according to the invention with a color developing agent, thereby, as a function of imagewise exposure, reducing the radiation-sensitive silver halide grains to silver while creating oxidized color developing agent and reacting the oxidized color developing agent with the dye image-forming compound to create a dye image, (2) converting to silver halide the silver mirror coating and the silver produced by development, and (3) fixing the photographic element while concurrently crosslinking the hydrophilic colloid contained in the emulsion layer unit to the hydrophilic colloid contained in the undercoat.

It has been discovered that the addition of the silver mirror coating increases imaging speed by at least one half stop (0.15 log E, where E represents exposure in lux-seconds) and eliminates the need for an antihalation layer to achieve acceptable levels of image acuity. This is because the silver mirror coating is specularly reflective, whereas reflections from the transparent film supports or white supports conventionally employed in color negative and color print photographic elements, respectively, are primarily diffuse.

The photographic elements differ from conventional photographic elements that employ metal sheet or foil supports. The silver mirror coating is removed during photographic processing. This allows exposure of a color print element through a fully processed color negative element satisfying invention requirements, whereas this function cannot be performed using a color photographic element with a metal sheet or foil support. Similarly, in color print elements constructed according to the invention, removal of the silver mirror coating during processing allows dye images to be viewed against a white, reflective background, as is conventional practice, rather than against a reflective metal background, as occurs in elements containing a permanent metal sheet or foil support.

To allow the silver mirror coating to be removed during processing while retaining adhesion of the dye image containing layers to the support of the photographically processed element, it has been necessary to add an undercoat beneath the silver mirror coating and to modify conventional processing to include crosslinking in the fixing step. Thus, modifications in photographic element structure and photographic processing that have no counterpart in photographic elements having reflective metal supports or their processing have been introduced to make possible the advantages of the invention.

Still other modifications of element structure and processing and resulting advantages are described in the following discussion of preferred embodiments.

DESCRIPTION OF PREFERRED EMBODIMENTS

In the simplest contemplated form a photographic element satisfying the requirements of the invention can be illustrated by Element A:

| Emulsion Layer Unit |
|---|
| Silver Mirror Coating<br>Undercoat<br>Support |

Element A

The support can take the form of any convenient conventional photographic element support. The support is preferably transparent when used to form a negative dye image. Both colorless and tinted transparent supports are commonly employed. The most common transparent supports are film supports. In an alternative preferred form, the support can take the form of a conventional white, reflective support of the type conventionally employed in color print elements. To facilitate adhesion of hydrophilic colloid vehicle coatings to photographic film surfaces it is common to include in the support construction one or more adhesion promoting layers, commonly referred to as subbing layers. Subbing layers, which are not hydrophilic colloid layers, are formed of polymers specifically formulated to bond to both to hydrophobic supports, typically film supports, on which they are coated and to hydrophilic colloid layers that are coated over the subbing layers. Details of support constructions, including subbing layers to enhance adhesion, are disclosed in *Research Disclosure*, Item 38957, cited above, XV. Supports.

The undercoat is comprised of a hydrophilic colloid containing crosslinking sites. In other words, the undercoat can be constructed of any of the hardenable hydrophilic colloid vehicles conventionally employed to form processing solution permeable layers of photographic elements. Although a wide variety of hydrophilic colloid vehicles are known to be useful in photographic element layer construction, gelatin and gelatin derivatives are most commonly employed as hydrophilic colloid vehicles.

To limit water ingestion and therefore swelling during processing the hydrophilic colloid present in the undercoat is hardened. In most photographic element constructions hydrophilic colloid layers are fully forehardened. That is, they are hardened sufficiently to eliminate the need to add a prehardener during processing. Since the undercoat is contemplated to be acted on by a crosslinking agent during the fixing step, it is recognized that the extent of initial hardening of the undercoat can be reduced to levels that are conventional when prehardening (processing solution hardening) is relied upon to supplement the hardening action of the forehardener.

Hydrophilic colloid vehicles (including peptizers and binders) as well as vehicle extenders, such as latices, hydrophilic colloid modifiers (e.g., hardeners) as well as other related addenda are disclosed in *Research Disclosure*, Item 38957, II. Vehicles, vehicle extenders, vehicle-like addenda and vehicle related addenda.

The thickness of the undercoat can be varied within the conventional thickness ranges of photographic element hydrophilic colloid layers. The minimum thickness is limited only by the ability to form a continuous coating. A typical preferred minimum hydrophilic colloid coating coverage is at least 0.25 mg/dm$^2$. The thickness of the undercoat can be increased to accommodate optional addenda, if desired. It is generally preferred to maintain the hydrophilic colloid coating coverage of the undercoat at less than 100 mg/dm$^2$. A specifically preferred thickness range for the undercoat is from 0.5 to 25 mg/dm$^2$.

After the undercoat has been formed on the support, the specularly reflective silver mirror coating is formed on the undercoat. The thickness of the silver coating is chosen to provide a significant reflection of incident light during imagewise exposure of the element. It is preferred to employ a silver coating thickness sufficient to reflect at least 50 percent of incident light. That corresponds to a silver mirror coating having a transmission density of 0.3 and, in terms, of its silver coating coverage, approximately 1 mg/dm$^2$ silver.

Since the silver must be removed during photographic processing, a balance must be struck between reflectance of incident light and the amount of silver coated. A practical maximum silver coating coverage is that which reflects 90 percent of incident light, which corresponds to a silver mirror coating having a density of 2.0 and, in terms, of its silver coating coverage, less than 7 mg/dm$^2$ silver.

Any conventional technique for forming the silver mirror coating can be employed. A preferred technique is to form the silver mirror coating by vacuum vapor deposition. The deposited silver adheres to the hydrophilic colloid in the undercoat.

The emulsion layer unit coated over the silver mirror coating can, in its simplest form, consist of a single conventional silver halide emulsion layer. The minimum essential components of the emulsion layer are (1) radiation-sensitive silver halide grains, (2) a hydrophilic colloid vehicle acting as a peptizer for the grains and a binder for the layer, and (3) a dye image-forming compound.

In use, Element A is imagewise exposed to light that strikes the emulsion layer unit. A portion of this light is absorbed by the radiation-sensitive grains in the emulsion layer unit while a significant fraction of the light passes through the emulsion layer unit and strikes the silver mirror coating. The silver coating is specularly reflective. That is, its reflectance is like that of a mirror in that it reflects light back with a low degree of light scatter. The term "specular" is defined by W. P. Ewald, W. A. Young and R. H. Roberts, *Practical Optics*, published by Image Makers of Pittsford, Pittsford, N.Y., 1983, as a "reflection in which parallel incident rays emerge as parallel reflected rays." For example, when incident light travelling in a direction perpendicular to the upper surface of the emulsion layer unit strikes the reflective silver coating, it is almost entirely reflected back along its original path. Thus, most of the light reflected back from the silver coating travels through the same path within the emulsion layer unit. Thus, halation, created by back scatter of light, as occurs from a white reflective or transparent support, is minimal. When incident light does not initially strike perpendicular to the emulsion layer unit, the specularly reflected light does not travel along the same path, but it lateral displacement is negligibly small due to the proximity of the emulsion layer unit to the point of reflection and the specularity of the light reflected.

As the reflected light traverses the emulsion layer a second time, a significant portion of the reflected light is absorbed. This second traverse has the effect of increasing the observed speed of the photographic element.

If Element A is modified by removing the silver mirror coating and the undercoat, a lower image acuity is observed, since back scattered light creates halation. If Element A is converted to a conventional form by removing the silver mirror coating and introducing an antihalation dye in the undercoat, image acuity is improved, but speed is reduced, since the antihalation dye prevents any significant portion of light from traversing the emulsion layer unit for a second time. If the silver mirror coating is removed to the back side of a transparent support, so that light must twice traverse the support before it is can reach the emulsion layer unit a second time, image sharpness is greatly reduced, since the path length that exposing light must travel between its first and second counters with the emulsion layer unit is greatly lengthened.

Although the silver mirror coating plays an important role in providing higher imaging speed with acceptable levels of image acuity, a silver mirror coating does not provide the transparent background needed to use a color negative element for printing or the white background desired when the dye image is to be viewed. Thus, it is specifically contemplated to remove the silver mirror coating during photographic processing. While many metals are capable of creating mirror-like coatings, the choice of silver is advantageous in that silver can be removed by the conventional photographic processing steps used to remove silver during processing of color photographic elements, but with a significant modification, described below.

Any conventional color development step can be practiced following imagewise exposure of Element A, such as those described above in connection color negative and color print processing. Imagewise developed silver halide grains are converted to silver while oxidizing developing agent for subsequent reaction with the dye image-forming compound, thereby producing a dye image.

In a subsequent step the developed silver as well as the silver mirror coating are converted to silver halide by a conventional bleaching step, and the silver halide is solubilized by a conventional fixing step. The bleaching and fixing steps can be performed sequentially by bringing Element A into contact with a bleach bath and then a fix bath. Alternatively, bleaching and fixing can be performed in a single bleach-fix (a.k.a., blix) bath.

It has been observed that successful photographic processing is not possible following conventional color processing techniques, since the emulsion layer unit or units overlying the silver mirror coating separate from the element when the silver halide derived from silver mirror coating in bleaching is removed during fixing. As previously mentioned, when the mirror coating is formed, it adheres to the underlying hydrophilic colloid undercoat. Similarly, the emulsion layer unit coated over the silver mirror coating adheres to it, since the emulsion layer unit contains hydrophilic colloid as a vehicle. During bleaching, the silver mirror coating is converted to silver halide. Adhesion between hydrophilic colloid and silver halide is well recognized and is, in fact, relied upon for silver halide grain dispersion in emulsion layers. However, when the silver halide derived from the silver mirror coating is solubilized during fixing, the overlying emulsion layer unit is left without a bonding linkage to the undercoat. Thus, the layers initially overlying the silver mirror coating separate from the element in the fixing step.

It has been discovered that separation can be prevented by forming crosslinking bridges between the undercoat and overlying emulsion layer unit while fixing is occurring. One technique that can be employed is to activate the undercoat hydrophilic colloid surface so that it will spontaneously react with any hydrophilic colloid that is brought into contact with it. Immediately thereafter the silver mirror coating is vacuum vapor deposited on the activated hydrophilic colloid surface of the undercoat. This isolates the activated surface so that it is incapable of reacting with the hydrophilic colloid present in the emulsion layer unit coated over the silver mirror coating until the silver coating is physically removed during photographic processing. Once the silver mirror coating is physically removed, the hydrophilic colloid of the overlying emulsion layer unit immediately reacts with the activated surface of the undercoat. A commonly employed activation technique of the type here contemplated is to bombard the hydrophilic colloid undercoat with electrons or to pass the hydrophilic colloid undercoat through a corona discharge. This kind of treatment severs carbon-to-carbon bonds in the hydrophilic colloid, leaving the hydrophilic colloid in a highly reactive state.

Another technique for achieving the required crosslinking between the undercoat and the overcoated emulsion layer unit is to incorporate a crosslinking agent in the fixing or bleach-fixing bath that is capable of forming crosslinking bonds while fixing is occurring. Most of the hardeners used as crosslinking agents for hydrophilic colloid layers of photographic elements are unsuitable for use as crosslinking agents in the practice of the invention. The reason for this is that the crosslinking action of the commonly used vehicle hardeners requires an extended period of time, measured in hours or days, to complete. Thus, the commonly used hardeners are ineffective to bond the overlying layer units to the undercoat while fixing is occurring.

Although organic hardeners are most commonly employed in hardening photographic elements, inorganic hardeners are known, as illustrated by James *The Theory of the Photographic Process,* 4th Ed., Macmillan, New York, 1977, pp. 78 and 79 (here incorporated by reference). It has been observed that water soluble salts of polyvalent metals of the type disclosed by James under the topic Inorganic Hardeners are useful as crosslinking agents in the practice of the invention.

There are a wide variety of polyvalent metals to choose among, such as iron, chromium, aluminum, manganese, indium, thallium, gallium, vanadium, cobalt, titanium, rhodium, and zirconium. Chromium compounds have been most extensively employed as inorganic hardeners. Examples of suitable chromium compounds include the following: chromium hydroxides, oxalates, citrates, malonates, lactates, tartrates, succinates, acetates, formates, sulfates, chlorides, nitrates and perchlorates of chromium. Another preferred polyvalent metal is aluminum. Examples of suitable aluminum compounds include aluminum sulfate, potassium alum, and ammonium alum. Still another preferred polyvalent metal is zirconium. Examples of suitable zirconium compounds include the complexes of zirconium with tartaric acid, citric acid, malonic acid, lactic acid, and salicylic acid.

In one preferred form the polyvalent metal compound can take the form of an alum satisfying the formula:

$M_2SO_4M'_2(SO_4)_3$ where

M is a monovalent cation and

M' is a trivalent metal ion.

Examples of M include alkali metal, ammonium, silver and hydroxylamine ions. The ammonium cation can take the form of $NH_4^+$ or $NR_4^+$, where R is four independent organic ligands or two or more R's complete a ring to form a quaternary ammonium heterocyclic cation. Although quaternized ammonium cations are preferred, it is appreciated that all combinations of hydrogen and organic ligands are possible in the ammonium ions. The trivalent cation M' can be chosen from among the polyvalent metals noted above, with chromium and aluminum being specifically preferred. Common alums include ammonium alum, ammonium chrome alum, ammonium iron alum (ferriammonium sulfate), cesium alum (cesium aluminum sulfate), chrome alum (sodium chromic sulfate), common alum (aluminum potassium sulfate), iron alum (ferric potassium sulfate), potassium alum (aluminum potassium sulfate), potassium chrome alum (chromic potassium sulfate), potassium manganese alum (potassium manganic sulfate), rubidium alum (aluminum rubidium sulfate), and sodium alum (aluminum sodium sulfate).

The concentration of the crosslinking agent incorporated in the fixing solution is chosen to provide a concentration of from 0.01 to 2 percent by weight, based on the weight of the hydrophilic colloid in the photographic element being processed. A preferred concentration is from 0.1 to 1 percent by weight, based on the weight of the hydrophilic colloid.

By performing both fixing and crosslinking in a single processing step, the physical integrity of the photographic element of the invention is maintained. At the completion of photographic processing an element is available having a level of physical integrity acceptable for subsequent physical handling.

In the simplest possible construction noted above (e.g., Element A), the processed element exhibits a low level of image dye density (fog). The origin of the dye fog can be traced to the presence of a $Ag^+$ diffusion path from the silver halide grains to the silver mirror coating during the color development step. Although silver halide has very low levels of solubility, the silver halide grains nevertheless exist in the emulsion in an equilibrium with silver ions and halide ions. It is well known that $Ag^0$ (here provided by the silver mirror coating) is a catalyst for the reaction of silver ion with color developing agent; hence, the observation of dye fog.

The dye fog is not of a magnitude to destroy the utility of the photographic elements of the invention and can therefore be tolerated for at least color error tolerant imaging applications. However, for most imaging applications, it is preferred to reduce or eliminate dye fog attributable to the very small quantities of silver ion created by silver halide equilibration. This can be accomplished by incorporating an oxidized developing agent scavenger in the emulsion layer unit that lies in contact with the silver mirror coating. In the simplest possible arrangement, the oxidized developing agent scavenger is uniformly distributed within the emulsion layer adjacent the silver mirror coating. The oxidized developing agent scavenger reacts with a portion of the color developing agent that reacts with silver ion at the surface of the silver mirror coating. A reduction, but not an elimination of dye fog results.

If the oxidized developing agent scavenger is uniformly distributed within the emulsion layer next adjacent the silver mirror coating, it will, in addition to reducing dye fog, also contribute to a reduction in maximum density, since it will intercept oxidized developing agent prior to reaction with dye image-forming compound independently of the origin of the oxidized developing agent. The eye being more sensitive to reductions in low dye density levels than high dye density levels, the viewer will nevertheless favor images produced with lower minimum dye densities attributable to the presence of oxidized developing agent scavenger over images produced by the same element with the oxidized developing agent scavenger absent.

To improve the efficiency of the oxidized developing agent scavenger in reducing dye fog, it is preferred to locate the oxidized developing agent scavenger in a hydrophilic colloid layer of the emulsion layer that is interposed between the silver mirror coating and the nearest silver halide emulsion layer. This layer can be loaded with sufficient oxidized developing agent scavenger to eliminate dye fog attributable to the silver mirror coating catalyzing color developing agent oxidation. Further, the act of interposing a layer between the nearest emulsion layer and the silver mirror coating in itself reduces the amount of dye fog that would otherwise form in the absence of the oxidized developing agent scavenger.

The term "oxidized developing agent scavenger" is employed to indicate any compound that spontaneously reacts with oxidized color developing agent to produce a colorless compound. When the oxidized developing agent scavenger is uniformly incorporated in a single emulsion layer unit, such as illustrated in Element A, the mobility of the oxidized developing agent scavenger in the emulsion layer unit is immaterial. However, where it is preferred to localize the oxidized developing agent scavenger in a specific location, as in the interlayer described above and in conventional color photographic elements in interlayers between emulsion layer units, it is preferred to incorporate in the oxidized developing agent scavenger a bulky moiety to restrict mobility, commonly referred to as a ballast. Oxidized development agent scavenging compounds, also sometimes referred to as anti-stain agents, are illustrated by *Research Disclosure*, Item 38957, X. Dye image formers and modifiers, D. Hue modifiers/stabilization, paragraph (2). The most commonly employed oxidized developing agent scavengers are ballasted polyfunctionalized aromatic compounds containing multiple hydroxy, amino, and sulfonamido groups, and combinations thereof. Known oxidized developing agent scavengers include ballasted hydroquinone (1,4-dihydroxybenzene) compounds as described in Kneckel et al U.S. Pat. No. 3,700,453; ballasted gallic acid (1,2,3-trihydroxybenzene) derivatives as described in Shigeo et al U.S. Pat. No. 4,474,874; ballasted sulfonamidophenols as described in Erickson et al U.S. Pat. No. 4,205,987 and Ross et al U.S. Pat. No. 4,447,523; ballasted resorcinol (1,3-dihydroxybenzene) described in Gates et al U.S. Pat. No. 3,770,431; naptholic couplers which form a dye that is removed from the photographic recording material during color development and subsequent processing as described in Begley et al U.S. Ser. No. 08/846,910, filed Apr. 30, 1997; and ballasted hydrazides as described in Harder U.S. Pat. No. 4,923,787 and Harder et al U.S. Pat. No. 5,629,140. The disclosures of the references just described are incorporated herein by reference.

The oxidized developing agent scavenger can be used in conventional levels. When the oxidized developing agent scavenger is located in the interposed layer described above, higher than conventional levels are feasible. However, it is generally preferred to limit oxidized developing agent scavenger concentrations to less than 0.15 mmol/$m^2$, with a preferred minimum concentration being at least 0.05 mmol/$m^2$.

The radiation-sensitive silver halide grains in the emulsion layer unit can be provided by any silver halide emulsion capable of forming a latent image upon exposure known to be useful in color negative photographic elements. Illustrations of conventional radiation-sensitive silver halide emulsions, including both tabular and nontabular grain emulsions, are provided by *Research Disclosure*, Item 38957, I. Emulsion grains and their preparation. It is generally recognized that the presence of a minor proportion of iodide in the grains is capable of increasing photographic speed. Hence, particularly for color negative imaging applications, it is preferred to incorporate from 0.5 to 10, most commonly 1 to 5, mole percent iodide, based on silver, in the silver halide grains. While high speed silver iodochloride and chloride {100} tabular grain emulsions are known and can be used for incorporation in color negative elements, it is common practice to employ iodide containing high bromide (>50 mole percent bromide, based on silver) in color negative photographic elements.

In color print elements high chloride (>50 mole percent chloride, based on silver) emulsions are commonly employed. Since the equilibrium solubility of silver chloride is much higher than that of silver bromide or silver iodide, the use of oxidized developing agent scavenger as described above in high chloride emulsion containing photographic elements according to the invention is particularly contemplated.

The radiation-sensitive emulsions are chemically and, in the overwhelming majority of applications, spectrally sensitized. Varied chemical and spectral sensitizations are illustrated by *Research Disclosure*, Item 38957, IV. Chemical sensitization and V. Spectral sensitization and desensitization, A. Sensitizing dyes.

The dye image-forming compound can take any convenient conventional form. As is well understood in the art, the dye image-forming compound is most commonly coated in a layer unit in the same layer as the radiation-sensitive emulsion. It is a known alternative to coat the dye image-forming compound in the layer unit in a hydrophilic colloid layer that lies in contact with the radiation-sensitive emulsion. Varied illustrations of dye image-forming compounds are contained in *Research Disclosure*, Item 38957, X. Dye image formers and modifiers. Specifically preferred dye image-forming compounds are dye-forming couplers, illustrations of which specifically provided in X. Dye image formers and modifiers, cited above, B. Image-dye-forming couplers.

The simple color photographic element construction of Element A produces a single color dye image. It is common to use a mixture of dye image formers to produce a black dye image, such elements commonly being referred to as chromogenic black-and-white photographic elements. More typically three superimposed emulsion layer units are coated over the reflective silver coating, each recording exposure in a different one of the red, green and blue regions of the spectrum, thereby allowing the color of the subject image to be replicated.

A typical element according to the invention capable of use in replicating subject image colors is illustrated by the following:

| Protective Layer Unit |
|---|
| Blue Recording Emulsion Layer Unit |
| Green Recording Emulsion Layer Unit |
| Red Recording Emulsion Layer Unit |

-continued

| Protective Layer Unit |
|---|
| Silver Mirror Coating |
| Undercoat |
| Support |

Element B

The support, undercoat and silver mirror coating can be identical to those described above in Element A and therefore require no further description.

Each of the blue, green and red recording layer units contain the essential features (radiation-sensitive silver halide grains, hydrophilic colloid and dye image-forming compound) of the emulsion layer unit of Element A. The emulsion layer unit coated nearest the silver mirror coating (in Element B, the red recording layer unit) preferably contains oxidized developing agent scavenger, either uniformly distributed or in an interlayer interposed between the silver mirror coating and silver halide grains in the emulsion layer unit. The green and red recording layer units are spectrally sensitized to the green and red regions of the spectrum. The blue recording layer unit is usually spectrally sensitized to the blue region of the spectrum, but blue spectral sensitization can be omitted where native blue sensitivity is adequate.

Each of the blue, green and red recording layer units contains a dye image-forming compound that reacts with color developing agent to form a dye image of a different hue. Where replication of the hue of the photographic subject is intended, the blue recording layer unit contains a yellow dye-image forming compound, the green recording layer unit contains a magenta dye-image forming compound, and the red recording layer unit contains a cyan dye-image forming compound.

When Element B is a color negative element, it also preferably contains masking dyes (usually masking couplers that form masking dyes on processing) in the layer units to offset unwanted absorptions in the image dyes produced by photographic processing. Masking dyes, including masking couplers, are disclosed in *Research Disclosure*, Item 38957, XII. Features applicable only to color negative, particularly paragraphs (1) and (2).

If desired, each of the blue, green and red recording layer units can be divided into two or three superimposed emulsion layers differing in sensitivity. If a faster emulsion layer is coated over a slower emulsion layer, a higher speed is realized than when the same emulsions are blended and coated in one layer. Alternatively, when the slower emulsion layer is coated over the faster emulsion layer, a higher contrast is realized than when the same emulsions are blended and coated in one layer. Emulsion layer units divided into faster and slower emulsion layers are described in *Research Disclosure*, Item 38957, I. Emulsion grains and their preparation, E. Blends, layers and performance categories, particularly paragraph (7).

In the emulsion layer unit coating sequence shown in Element B, the red recording layer unit is coated nearest the silver mirror coating and preferably contains oxidized developing agent scavenger as described above. Oxidized developing agent scavenger can also be present in the green and/or blue recording layer units. Preferably the green recording layer unit includes a hydrophilic colloid layer free of radiation-sensitive silver halide grains contacting the red recording layer unit and containing oxidized color developing agent scavenger. Similarly the blue recording layer unit preferably includes a hydrophilic colloid layer free of radiation-sensitive silver halide grains contacting the green recording layer unit and containing oxidized color developing agent scavenger.

When the radiation-sensitive silver halide grains in the green and red recording layer units exhibit significant native blue sensitivity, as is typical of silver iodobromide grains, it is preferred to incorporate a blue absorber that can be removed on processing in a hydrophilic colloid layer of the blue recording layer unit free of radiation-sensitive silver halide grains contacting the green recording layer unit. It is also known to incorporate the blue absorber in the corresponding layer of the green recording layer unit. Carey Lea silver and processing solution decolorizable dyes are commonly employed, illustrated in *Research Disclosure*, Item 38957, VIII. Absorbing and scattering materials, B. Absorbing materials and C. Discharge.

In Element B the blue recording layer unit is coated to receive exposing radiation prior to the remaining layer units and the red recording layer unit is coated to receive exposing radiation after the remaining layer units. This layer unit arrangement is particularly advantageous when the green and/or red recording layer units exhibit significant native blue sensitivity. However, when the level of native blue sensitivity is low, as is typically of high chloride radiation-sensitive emulsions and tabular grain emulsions, the preferred layer order arrangement is for the green recording layer unit to be coated to first receive exposing radiation with the red recording layer unit next receiving exposing radiation, and the blue recording layer unit last receiving exposing radiation. The advantage of this arrangement is that the relative acuity (with green being highest and blue being lowest) of the images is matched to the relative sensitivity of the human eye to these spectral regions. Varied layer order arrangements are illustrated by Kofron et al U.S. Pat. No. 4,439,520, the disclosure of which is here incorporated by reference.

It is also recognized that advantages can be realized by interleaving faster and slower emulsion layers of the green and red recording layer units. This is illustrated by *Research Disclosure*, Item 38957, XI. Layers and layer arrangements, particularly paragraph (2).

The protective layer unit can take any convenient conventional form or be omitted entirely. In practice the protective layer unit provides physical protection for the dye image-forming layer units during handling and processing and provides a convenient site of introducing addenda, particularly those that modify surface properties. The protective layer unit is commonly comprised of one or two hydrophilic colloid layers that are provided for physical protection of the color negative elements during handling and processing. In a preferred form the protective layer unit is divided into a surface layer and an interlayer, the latter functioning as a spacer between the addenda in the surface layer and the adjacent recording layer unit. In another common variant form, addenda are distributed between the surface layer and the interlayer, with the latter containing addenda that are compatible with the adjacent recording layer unit. Most typically the protective layer unit contains addenda, such as coating aids, plasticizers and lubricants, antistatic agents and matting agents, such as illustrated by Research Disclosure, Item 38957, IX. Coating physical property modifying addenda. It is also common practice to coat an overcoat layer on the back side of the support to locate some or all of the physical property modifying addenda also adjacent to the back surface of the film. The overcoat layers overlying the emulsion layers additionally preferably contain an ultraviolet absorber, such as illustrated by *Research Disclosure*, Item 38957, VI. UV dyes/optical brighteners/luminescent dyes, paragraph (1).

A number of modifications of color negative elements have been suggested for accommodating scanning, as illustrated by *Research Disclosure*, Item 38957, XIV. Scan facilitating features. These systems to the extent compatible with the color negative element constructions described above are contemplated for use in the practice of this invention. However, the systems in paragraph (1) that rely on unbleached silver to replace one image dye or employ reflective or fluorescent interlayers to facilitate scanning, are not compatible with the present invention. The features of paragraphs (2) and (3) are generally compatible with the preferred forms of the invention.

The color photographic elements of the invention can be imagewise exposed within the visible spectrum in any convenient conventional manner. *Research Disclosure*, Item 38957, XVI. Exposure illustrates varied exposures.

Multicolor dye images which correspond to the silver halide rendered selectively developable by imagewise exposure, typically negative dye images, can be produced by conventional processing. Such processing, particularly adapted for processing color negative elements, is illustrated by the Kodacolor C-22, the Kodak Flexicolor C-41 and the Agfacolor processes described in *British Journal of Photography Annual,* 1977, pp. 201–205 and *British Journal of Photography Annual,* 1988, pp. 196–198, Kodak motion picture film processes ECN-2, ECN-2a and ECN-2b, and the Kodak ECP Process as described in Kodak Publication No. H-24, *Manual For Processing Eastman Color Films.*

The photographic elements can also be processed by the Kodak Ektaprint 2 Process as described in Kodak Publication No. Z-122, the Kodak Ektaprint-3 and -300 processes as described in Kodak Color Dataguide, 5th Ed., 1975, pp. 18–19, and the Agfa color process as described in *British Journal of Photography Annual,* 1977, pp. 205–206, such processes being particularly suited to processing color print materials, such as resin-coated photographic papers, to form positive dye images. Rapid-access processing of color print materials employing high-chloride silver halide emulsions, such as Process RA-4, is described in the *British Journal of Photography Annual,* 1988, pp. 198–199, Vincent et al WO 87/04534 and U.S. Pat. No. 4,892,804, Koshimizu et al U.S. Pat. No. 4,774,167, Ishikawa et al U.S. Pat. Nos. 4,851,326 and 4,876,174, Wernicke U.S. Pat. No. 4,925,778, Fujimoto et al U.S. Pat. No. 4,965,175, Ishikawa et al U.S. Pat. No. 4,968,588, Wernicke et al U.S. Pat. No. 4,997,749, Meckl et al U.S. Pat. No. 5,021,326, Kuse et al U.S. Pat. No. 5,028,517, Wernicke U.S. Pat. No. 5,063,144, Yoshida et al U.S. Pat. No. 5,077,180, Fujimoto et al U.S. Pat. No. 5,091,292, Furusawa et al U.S. Pat. No. 5,110,714, Yoshida et al U.S. Pat. No. 5,153,111, Kobayashi et al EPO 0 243 100, Wernicke et al EPO 0 312 893, and Satake et al EPO 0 468 781. A method for coating development is described in Iwano U.S. Pat. No. 5,200,302. The use of more than one developer bath is described in Hassler et al EPO 0 365 955 and Wenicke et al EPO 0 436 917.

Color development requires at least one color developing agent. These typically take the form of an aromatic ring, such as benzene, substituted with one or two primary amines. They include aminophenols and p-phenylenediamines, especially N,N-dialkyl-p-phenylenediamines. The alkyl moieties can be substituted or unsubstituted and typically each contain from 1 to 6 carbon atoms, inclusive of substituents. As illustrated by James, cited above, p. 353, structure (1), p-phenylenediamines commonly have a substituent ortho to the primary amine substituent to modify the solubility of the color developing agent and the absorption wavelength of the image dye produced on coupling. Table 12.6, page 354, of James shows the effect of varied p-phenylenediamine substituents on image dye maximum absorption wavelengths ($\lambda$max).

Examples of specific aminophenol developing agents include o-aminophenol, p-aminophenol, 5-amino-2-hydroxytoluene, 2-amino-3-hydroxytoluene, and 2-hydroxy-3-amino-1,4-dimethylbenzene. Examples of specific p-phenylenediamine color developing agents include: N,N-diethyl-p-phenylenediamonohydrochloride, 4-N,N-diethyl-2-methylphenylenediamine monohydrochloride, 4-(N-ethyl)-N-2-methanesulfonylaminoethyl)-2-methylphenylenediamine sesquisulfate monohydrate and 4-(N-ethyl-N-2-hydroxyethyl)-2-methylphenylenediamine sulfate.

Generally, the amount of color developing agent in the color developer is from about 0.01 to about 0.1 mole/liter, with from about 0.02 to 0.06 mole/liter being preferred.

In addition to color developing agent the developer can also include one or more of a variety of other addenda which are commonly used in such solutions, including alkali metal halides (such as potassium chloride, potassium bromide, sodium bromide and sodium iodide), metal sequestering agents (such as polycarboxylic or aminopolycarboxylic acids or polyphosphonates), other preservatives (such as sulfites, alcoholamines, amino acids and polysaccharides), antifoggants, development accelerators, optical brighteners, wetting agents, stain reducing agents, surfactants, and defoaming agents. Such addenda are illustrated by *Research Disclosure*, Item 38957, XIX. Development, and Koboshi et al U.S. Pat. No. 4,814,260, here incorporated by reference. Conventional amounts of such developer additives can be employed. For example, the amounts of halides can be varied widely, but are generally at least about $5\times10^{-5}$ to about 0.4 mol/liter for bromide ion and at least about $5\times10^{-7}$ and up to about 0.01 mol/liter for iodide ion. The incorporation of chloride ion in the developer solution is optional, since chloride ion essentially has no effect on performance. Thus, generally, chloride ion is not added or present, but if it is, it is not detrimental to the invention. The incorporation of bromide and iodide ions in the color developer can be beneficial.

Color developing compositions are employed in the form of aqueous alkaline working solutions having a pH of above 7 and typically in the range of from 9 to 13. To provide the necessary pH, the solutions contain one or more of the well known and widely used buffering agents, such as the alkali metal carbonates or phosphates. Potassium carbonate is especially useful as a buffering agent for color developing compositions.

Once the dye images are obtained by development it is conventional practice to reconvert developed silver to silver halide by bleaching and then to remove the silver halide by fixing. Removal of the silver image removes the neutral silver density that is superimposed on the image dye density thereby constituting a hindrance to printing or scanning. Removal of the silver halide by fixing is undertaken to allow the developed color negative element to be handled in room light without printout (that is, without reduction of the remaining silver halide to silver) which objectionably increases minimum densities of each of the dye images. Bleaching and fixing can both be accomplished in a single bleach-fix (a.k.a., blix) solution, if desired. It is common practice to use a stop bath, such as dilute acetic acid, to lower pH and terminate color development. Usually washing or rinsing steps are conducted between development and bleaching and, where separate bleach and fix solutions are employed, between the bleaching and fixing step. A washing step is also commonly used after fixing.

Conventional bleaching agents are illustrated by *Research Disclosure*, Item 38957, XX. Desilvering, washing, rinsing and stabilizing, A. Bleaching. Following or concurrently with bleaching the silver halide is removed from the color photographic element by fixing agents to prevent unwanted printout of silver in the image bearing element by prolonged exposure to light. Fixing agents are water-soluble solvents for silver halide such as a thiosulfate (e.g., sodium thiosulfate, ammonium thiosulfate, and potassium thiosulfate), a thiocyanate (e.g., sodium thiocyanate, potassium thiocyanate and ammonium thiocyanate), a thioether compound (e.g., ethylenebisthioglycolic acid and 3,6-dithia-1,8-octanediol), a thioglycolic acid or a thiourea, an organic thiol, an organic phosphine, a high concentration of halide, such as bromide or iodide, a mesoionic thiolate compound, and sulfite. These fixing agents can be used singly or in combination. Thiosulfate is preferably used and ammonium thiosulfate, in particular, is used most commonly owing to the high solubility. Alternative counter-ions such as potassium, sodium, lithium, cesium as well as mixtures of two or more cations may be used. Some fixing agents and their use in solid and liquid formulations are described in Mader U.S. Pat. No. 2,748,000, Bard U.S. Pat. No. 3,615,507, Nittel et al U.S. Pat. No. 3,712,818, Smith U.S. Pat. No. 3,722,020, Ling U.S. Pat. No. 3,959,362, Greenwald U.S. Pat. Nos. 4,126,459, 4,211,562, and 4,211,559, Atland et al U.S. Pat. No. 4,378,424, Fyson U.S. Pat. Nos. 5,171,658, 5,244,778 and 5,275,923, Rogers et al U.S. Pat. No. 5,389,501, Kojima et al EPO 0 458 277, EPO 0 431 568, and EPO 0 500 045, Hayashi EPO 0 557 851, Buttner et al EPO 0 610 763, and Kojima et al EPO 0 611 990. Some low ammonia fixing solutions are described in Schmittou et al U.S. Pat. No. 5,183,727, Yoshimoto et al EPO 0 466 510, Fyson EPO 0 550 933 and Szajewski et al EPO 0 605 036, EPO 0 605 038 and EPO 0 605 039.

The fixing or bleach-fixing solution may also contain preservatives such as sulfites (e.g., sodium sulfite, potassium sulfite, and ammonium sulfite), bisulfites (e.g., ammonium bisulfite, sodium bisulfite, and potassium bisulfite), metabisulfites (e.g., potassium metabisulfite, sodium metabisulfite, and ammonium metabisulfite), hydroxylamines, hydrazines, bisulfite adducts of carbonyl and aldehyde compounds (e.g., acetaldehyde sodium bisulfite), ascorbic acid, mercapto-substituted N-oxide compounds, and sulfinic acid compounds, e.g. as described in Watanabe et al U.S. Pat. No. 5,288,595. Compounds which may be added to accelerate fixing include polyoxyethylene compounds, amidine salts or amidine thiosulfates, ammonium or amine salts and organic amines, ammonium thiocyanate (ammonium rhodanate), thiourea and thioethers (for example, 3,6-dithia-1,8-octanediol) in combination with thiosulfates. Some fixing accelerators and their use are described in U.K. Patent 1,306,315, Barnes U.S. Pat. No. 2,174,494, *Photographische Industrie,* 40, 249 (1942), Schmittou et al U.S. Pat. No. 5,424,176 and EPO 0 569 008, and Rogers et al EPO 0 578 309. Sulfite fix accelerators are described in Fyson EPO 0 411 760.

The crosslinking agents that are active during fixing often have activity levels that are pH dependent. Fortuitously, maximum crosslinking activity levels are well within conventional pH ranges of fixing baths. In order to adjust the pH of the fixing solution an acid or a base may be added, such as hydrochloric acid, sulfuric acid, nitric acid, acetic acid, bicarbonate, ammonia, potassium hydroxide, sodium hydroxide, sodium carbonate or potassium carbonate. The fixing solution may contain sequestering agents such as aminopolycarboxylic and phosphonic acids. Some sequesterants and their use are described in Fujita et al U.S. Pat. No. 4,963,474, Craver et al U.S. Pat. No. 5,343,035 and U.S. Pat. No. 5,508,150, and Tappe et al EPO 0 486 909. Fixing solutions may also contain polymers as described in Fushiki et al U.S. Pat. No. 4,138,257 and Kojima et al U.S. Pat. No. 4,948,711, solubilizing agents as described in Ikegawa et al U.S. Pat. No. 5,097,042, stain reducing agents as described in Sasaki et al U.S. Pat. No. 5,120,635, and surfactants as described in Ueda et al EPO 0 441 309.

Some variations on the fixing processes already described include the high agitation process of Fujita et al U.S. Pat. No. 5,221,597, the fixing solution reuse of Tsuchiya et al EPO 0 465 076, the fixing cover sheet of Simons WO 93/12462, the processes of Ueda et al U.S. Pat. No. 5,194,368 and Nagashima et al U.S. Pat. No. 5,066,569, and the solid formulations of Kim et al U.S. Pat. No. 5,270,154.

The bleaching and fixing steps can be combined into a monobath bleach-fix step that can be used alone or in combination with the bleaching and the fixing step. A monobath bleach-fix is often used with a color paper process, such as the RA-4 Process described in the *British Journal of Photography Annual,* 1988, pp. 198–199. Examples of bleach-fixing solutions or dry formulations, and their use are further described in Hall et al U.S. Pat. No. 4,717,649, Ueda et al U.S. Pat. No. 4,818,673, Abe et al U.S. Pat. No. 4,857,441, Häseler et al U.S. Pat. No. 4,933,264, Ishikawa et al U.S. Pat. No. 4,966,834, Spriewald et al U.S. Pat. No. 4,987,058, Long et al U.S. Pat. No. 5,055,382, Abe et al U.S. Pat. No. 5,104,775, Goto et al U.S. Pat. No. 5,147,765, Tappe et al U.S. Pat. No. 5,149,618, Ishikawa U.S. Pat. No. 5,169,743, Kobayashi et al U.S. Pat. No. 5,180,656, Yoshida et al U.S. Patent 5,310,633, Fyson U.S. Pat. No. 5,354,647, Ishikawa et al EPO 0 434 097, Goto et al EPO 0 479 262, Nakamura et al EPO 0 565 023, Yoshida et al EPO 0 569 852, Gordon et al EPO 0 590 583 (bleach-fix replenisher) and EPO 0 645 674, Kamada et al EPO 0 686 875, and Wernicke et al German OLS 4,000,482.

Once fixing has been completed, it is common practice, but not essential, to further bathe the color photographic element to optimize its long term stability. Solutions and procedures for accomplishing this are illustrated by *Research Disclosure*, Item 38957, XX. Desilvering, washing, rinsing and stabilizing, D. Washing, rinsing and stabilizing.

EXAMPLES

The invention can be better appreciated by reference to the following specific embodiments.

EXAMPLE 1

This example illustrates the application of my invention to color negative photographic elements.

Control Coating 1A

A poly(ethylene terephthalate) photographic film support was coated with an undercoat of 5.4 mg/dm$^2$ of gelatin. It was then coated with a light sensitive melt to give a light sensitive layer containing 19.0 mg/dm$^2$ Ag of a 1. 1 $\mu$m×0.45 $\mu$m tabular grain silver iodobromide emulsion which had been chemically and green spectrally sensitized, 4.5 mg/dm$^2$ of yellow dye-forming coupler, 2.8 mg/dm$^2$ of magenta dye-forming coupler, 4.2 mg/dm$^2$ of cyan dye-forming coupler, 53.4 mg/dm$^2$ gelatin, 0.75 mg/dm$^2$ bis (vinylsulfonyl)methane and 1.2 mg/dm$^2$ saponin. The backside of the support contained a black antihalation layer.

Example Coating 1B

A poly(ethylene terephthalate) photographic film support was coated with an undercoat of 5.4 mg/dm$^2$ of gelatin. The support was then vacuum coated with silver metal at ~4.3 mg/dm$^2$ resulting in a metallic mirror. Over the silver mirror was then coated with the same light sensitive melt and at the same coverage as Control Coating 1A. The backside of the support also contained a black antihalation layer although it would not be expected to have any effect.

Example Coating 1C

This coating was prepared like Example Coating 1B, except that the gelatin undercoat was additionally hardened with bis(vinylsulfonyl)methane at one percent by weight, based on the weight of gelatin.

Exposure

Coatings 1A, 1B, and 1C were exposed for 0.01 sec to a 600W, 3,000 K. tungsten light source through Kodak Wratten™ 2B and 0.6 neutral density filters and a 0 to 4.0 density step-tablet.

Color Processing Without Crosslinking Agent in Fix Solution

Exposed Coatings 1A, 1B, and 1C were processed using the Kodak Flexicolor™ C-41 color negative process. No crosslinking agent was included in the fix solution.

Coating 1A showed a developed dye image of the step tablet exposure pattern. No image was present in Coatings 1B and 1C. In the latter elements the emulsion layer was observed to have separated from the undercoat in the fixing bath.

Color Processing With Crosslinking Agent in Fix Solution

Exposed Coatings 1A, 1B, and 1C were processed using the Kodak Flexicolor™ C-41 color negative process, but Kodak Rapid Fixer with Hardener Cat. No. 1464114 was substituted for the C-41 fix bath. The Kodak Rapid Fixer differed from the C-41 fix bath in that it contained an aluminum salt acting as a crosslinking agent.

A black-and-white chromogenic dye image was obtained for Coatings 1A, 1B, and 1C. The results are given in Table I. Note that Example Coatings 1B and 1C, that contained the silver mirror reflective coating, were about half-stop (0.15 log E) faster in speed than Control Coating 1A. Speed is reported as relative log speed measured at a density of 0.2 above fog. Each unit difference in speed amounts to 0.01 log E, where E is exposure in lux-seconds.

TABLE I

| Film Coating | Silver mirror coating | Hardened sublayer | Dmin | Dmax | Gamma | Relative speed at 0.2 above fog |
|---|---|---|---|---|---|---|
| 1A (control) | No | Yes | 0.17 | 0.99 | 0.51 | 100 |
| 1B (example) | Yes | No | 0.23 | 0.99 | 0.54 | 118 |
| 1C (example) | Yes | Yes | 0.26 | 1.00 | 0.52 | 117 |

EXAMPLE 2

This example illustrates the application of my invention to color print photographic elements.

Control Coating 2A

A resin coated (RC) paper support having a gelatin undercoat of 5.4 mg/dm$^2$ was coated with radiation-sensitive emulsion layer containing 0.7 mg/dm$^2$ Ag as an AgBrCl cubic grain emulsion which had been chemically sensitized and green spectrally sensitized, 2.5 mg/dm$^2$ of magenta dye-forming coupler, 14.1 mg/dm$^2$ gelatin, 0.30 mg/dm$^2$ bis(vinylsulfonyl)methane and 0.9 mg/dm$^2$ saponin.

Example Coating 2B

The same undercoated RC paper support used for Coating 2A was vacuum coated with ~2.5 mg/dm$^2$ of metallic silver resulting in a mirror-like coating. Over this coating was coated a layer containing 7.5 mg/dm$^2$ gelatin, 0.075 mg/dm$^2$ bis(vinylsulfonyl)methane, and 0.32 mg/dm$^2$ saponin. Over this layer was coated a light sensitive layer of the same composition used to make Control Coating 2A.

Example Coating 2C

This coating was prepared similarly to that of Example Coating 2B, except that it did not contain the 7.5 mg/dm$^2$ gelatin interlayer.

Example Coating 2D

This coating was prepared similarly to that of Example Coating 2B, except that the 7.5 mg/dm$^2$ gelatin interlayer additionally contained 0.65 mg/dm$^2$2,5-dioctylhydroquinone (DOH), an oxidized developing agent scavenger.

Exposure

Paper Coatings 2A, 2B, 2C, and 2D were exposed through a Kodak Wratten™ 8 filter, a 0 to 4.0 density step-tablet having 21 steps in 0.2 density increments each step having additionally a set of parallel lines spaced at 5 lines per mm. The widths of the lines and line separations were equal. The step having a density of 4.0 was assigned a step number of 1, and each successive step transmitted a 0.2 log E higher exposure than the step immediately preceding it. The exposure was at 0.10 sec using a 600 W, 3,000° K. tungsten light source.

Processing

The exposed coatings received Kodak RA-4 color paper photographic processing, but with 5 g/L of aluminum sulfate added to the bleach-fix bath.

A magenta dye image of the parallel lines at the 20 exposure steps showed varying degrees of magenta density and flare. With increased exposure, the flare became great enough to produce magenta density between the magenta lines and eventually totally obliterate the line pattern.

TABLE II

| Paper Coating | Ag° mirror | Minimum exposure step having magenta flare between lines. | Minimum exposure step with obliterated line pattern | Dmin | Interlayer between Ag mirror and AgX emulsion layer |
|---|---|---|---|---|---|
| 2A (control) | No | 11 | 15 | 0.11 | — |
| 2B (example) | Yes | 13 | 17 | 0.18 | 7.5 mg gel |
| 2C (example) | Yes | 13 | 17 | 0.24 | none |
| 2D (example) | Yes | 13 | 17 | 0.14 | 7.5 mg gel and 0.65 mg DOH |

The data in Table II shows that the example coatings having a silver mirror coating delayed image flare by a 0.4 log E exposure increase compared to the control coating, Paper Coating 2A.

From a comparison of Coatings 2B and 2C it is apparent that, when the silver mirror was in direct contact with the emulsion layer, a higher minimum density was observed. The further reduction of minimum density by placing oxidized developing agent scavenger in the interlayer separating the silver mirror and the emulsion layer in Coating 2D demonstrated that the silver mirror was contributing the minimum density in Coatings 2B and 2C by acting as a physical development catalyst.

The invention has been described in detail with particular reference to preferred embodiments thereof, but it will be understood that variations and modifications can be effected within the spirit and scope of the invention.

What is claimed is:

1. A photographic element comprised of a support and, coated on the support, an undercoat comprised of a hydrophilic colloid containing. crosslinking sites, a specularly reflective silver mirror coating, and an emulsion layer unit comprised of a hydrophilic colloid containing crosslinking sites, radiation-sensitive silver halide grains, and a dye image-forming compound.

2. A photographic element according to claim 1 wherein the support is a white, reflective support.

3. A photographic element according to claim 2 wherein the silver halide grains contain greater than 50 mole percent chloride, based on silver.

4. A photographic element according to claim 1 wherein the support is a transparent film support.

5. A photographic element according to claim 1 wherein the silver mirror coating reflects from 50 to 99 percent of light it receives during imagewise exposure of the photographic element.

6. A photographic element according to claim 1 wherein the hydrophilic colloid in the emulsion layer unit contacting the silver mirror coating contains an oxidized developing agent scavenger.

7. A photographic element according to claim 6 wherein the emulsion layer unit is comprised of at least one silver halide emulsion layer and, interposed between the emulsion layer and the silver mirror coating, a hydrophilic colloid layer containing at least a portion of the oxidized developing agent scavenger.

8. A photographic element according to claim 1 wherein the hydrophilic colloid undercoat has been activated to crosslink with the hydrophilic colloid forming the emulsion layer unit on contact.

9. A process of producing a viewable image comprising developing an imagewise exposed photographic element according to claim 1 with a color developing agent, thereby, as a function of imagewise exposure, reducing the radiation-sensitive silver halide grains to silver while creating oxidized color developing agent and reacting the oxidized color developing agent with the dye image-forming compound to create a dye image, converting to silver halide the silver mirror coating and the silver produced by development, and fixing the photographic element while concurrently crosslinking the hydrophilic colloid contained in the emulsion layer unit to the hydrophilic colloid contained in the undercoat.

10. A process according to claim 9 wherein crosslinking agent is contained in a fixing solution brought into contact with the photographic element during the fixing step.

11. A process according to claim 10 wherein the crosslinking agent is at least one water soluble salt of a polyvalent metal.

12. A process according to claim 11 wherein the polyvalent metal is chromium.

13. A process according to claim 12 wherein the crosslinking agent is a chromium hydroxide, carboxylate, sulfate, chloride, nitrate or perchlorate.

14. A process according to claim 11 wherein the polyvalent metal is aluminum.

15. A process according to claim 14 wherein the crosslinking agent is aluminum sulfate or an aluminum alum.

16. A process according to claim 11 wherein the crosslinking agent is an alum satisfying the formula:

$$M_2SO_4M'_2(SO_4)_3$$

where

M is a monovalent cation and

M' is a trivalent metal ion.

17. A process according to claim 16 wherein M is a quaternized ammonium moiety or an alkali metal and M' is aluminum, chromium or zirconium.

* * * * *